US008290413B2

(12) United States Patent
Kobayashi et al.

(10) Patent No.: US 8,290,413 B2
(45) Date of Patent: Oct. 16, 2012

(54) IMAGE FORMING APPARATUS

(75) Inventors: Kazuhiro Kobayashi, Kanagawa (JP); Kouji Amanai, Kanagawa (JP); Toshiyuki Uchida, Kanagawa (JP); Narumi Sugita, Kanagawa (JP); Kenji Tomita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/036,553

(22) Filed: Feb. 28, 2011

(65) Prior Publication Data

US 2011/0222920 A1 Sep. 15, 2011

(30) Foreign Application Priority Data

Mar. 15, 2010 (JP) ..... 2010-057309

(51) Int. Cl.
*G03G 15/01* (2006.01)

(52) U.S. Cl. ..... 399/299; 399/302

(58) Field of Classification Search ..... 399/299, 399/302

See application file for complete search history.

(56) References Cited

U.S. PATENT DOCUMENTS

| | | | | |
|---|---|---|---|---|
| 6,108,514 | A * | 8/2000 | Nakayama et al. | 399/400 |
| 6,853,829 | B2 * | 2/2005 | Hoshi et al. | 399/299 |
| 7,706,731 | B2 * | 4/2010 | Martin et al. | 399/302 X |

FOREIGN PATENT DOCUMENTS

| | | | |
|---|---|---|---|
| JP | 61061186 | A * | 3/1986 |
| JP | 02020882 | A * | 1/1990 |
| JP | 04055258 | A * | 2/1992 |
| JP | 07092820 | A * | 4/1995 |
| JP | 2011-13608 | | 1/2011 |
| JP | 2011-18019 | | 1/2011 |

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes a first image carrier facing an intermediate transfer belt, a primary transfer unit primarily transferring images on the first image carrier onto the intermediate transfer belt, a secondary transfer roller facing the intermediate transfer belt secondarily transferring images on the intermediate transfer belt onto a recording medium, a second image carrier provided upstream/downstream of a secondary transfer position in a recording medium conveying direction, a direct transfer unit directly transferring images on the second image carrier onto the recording medium, a recording medium carriage belt rotatably stretched across roller members including the secondary transfer roller supporting and conveying the recording medium to pass a direct transfer position and the secondary transfer position, and a displacement unit displacing the secondary transfer roller between a contact position where the recording medium carriage belt contacts the intermediate transfer belt and a separate position where it is separated therefrom.

18 Claims, 6 Drawing Sheets

IMAGE FORMING APPARATUS

CROSS-REFERENCE TO RELATED APPLICATIONS

The present application claims priority to and incorporates by reference the entire contents of Japanese Patent Application No. 2010-057309 filed in Japan on Mar. 15, 2010.

BACKGROUND OF THE INVENTION

1. Field of the Invention

The present invention relates to an image forming apparatus such as a printer, a facsimile, and a copying machine.

2. Description of the Related Art

Conventionally known is an image forming apparatus including a plurality of image forming units for a plurality of colors including black. Each image forming unit forms a color image of its corresponding color on an image carrier therein (such as the one disclosed in Japanese Patent Application Laid-open No. 2006-201743).

The image forming apparatus disclosed in Japanese Patent Application Laid-open No. 2006-201743 has a direct transfer position where a black image formed in a black image forming unit is directly transferred onto a recording medium and a secondary transfer position where images of the other colors primarily transferred onto an intermediate transfer belt from the image forming units of the other colors are secondarily transferred onto the recording medium from the intermediate transfer belt. The secondary transfer position is located upstream of the direct transfer position in a recording medium conveying direction. The intermediate transfer belt is rotatably stretched across a plurality of roller members, and a driving roller that is one of the roller members causes the intermediate transfer belt to rotate. Furthermore, provided is a recording medium carriage belt that is rotatably stretched across a plurality of roller members and supports and conveys the recording medium to pass through the secondary transfer position and the direct transfer position. At the secondary transfer position, the driving roller that stretches the intermediate transfer belt, and a secondary transfer roller are arranged. The secondary transfer roller is one of multiple roller members stretching the recording medium carriage belt and faces the driving roller sandwiching therewith the intermediate transfer belt and the recording medium carriage belt. At the secondary transfer position, the outer circumferential surface of the intermediate transfer belt at the position where it is supported by the driving roller is brought into contact with the outer circumferential surface of the recording medium carriage belt at the position where it is stretched across the secondary transfer roller to thereby form a secondary transfer nip. With the recording medium carriage belt, the recording medium is passed through the secondary transfer position and the direct transfer position to superpose the images in other colors transferred on the recording medium at the secondary transfer nip formed at the secondary transfer position and the image in black color transferred on the recording medium at the direct transfer position on the recording medium to form a full color image on the recording medium. The recording medium with the full color image formed thereon is conveyed to a fixing unit provided at the downstream of the direct transfer position in the recording medium conveying direction, and the full color image on the recording medium is fixed onto the recording medium by the fixing unit.

However, in the image forming apparatus disclosed in Japanese Patent Application Laid-open No. 2006-201743, even when forming the image on the recording medium with only the image forming unit for black color, the recording medium supported by the recording medium carriage belt comes into contact with the intermediate transfer belt at the secondary transfer position. Therefore, the intermediate transfer belt is easily degraded, which shortens the life of the intermediate transfer belt.

SUMMARY OF THE INVENTION

It is an object of the present invention to at least partially solve the problems in the conventional technology.

According to one aspect of the present invention, an image forming apparatus includes an intermediate transfer belt rotatably stretched across a plurality of roller members, a first image carrier arranged facing a front surface of the intermediate transfer belt, a first image forming unit that forms an image on the first image carrier, a primary transfer unit that primarily transfers the image formed on the first image carrier onto the intermediate transfer belt, a secondary transfer roller that is arranged facing the front surface of the intermediate transfer belt and secondarily transfers the image transferred on the intermediate transfer belt onto a recording medium, a second image carrier provided on an upstream side or a downstream side of a secondary transfer position in a recording medium conveying direction, the secondary transfer position being a position where an image is secondarily transferred from the intermediate transfer belt onto the recording medium, a second image forming unit that forms an image on the second image carrier, a direct transfer unit that directly transfers an image formed on the second image carrier onto the recording medium, a recording medium carriage belt that is rotatably stretched across a plurality of roller members including the secondary transfer roller and supports and conveys the recording medium so as to pass the recording medium through a direct transfer position and the secondary transfer position, the direct transfer position being a position where the image is directly transferred from the second image carrier onto the recording medium, and a displacement unit that displaces the secondary transfer roller in a movable manner between a contact position and a separate position, the contact position being a position where the recording medium carriage belt is brought into contact with the intermediate transfer belt and the separate position being a position where the recording medium carriage belt is separated from the intermediate transfer belt retracting from the contact position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A first embodiment will be described below. In the first embodiment, the present invention is applied to a color laser printer (hereinafter, simply referred to as a printer) that is an electrophotographic image forming apparatus.

Figure 2:
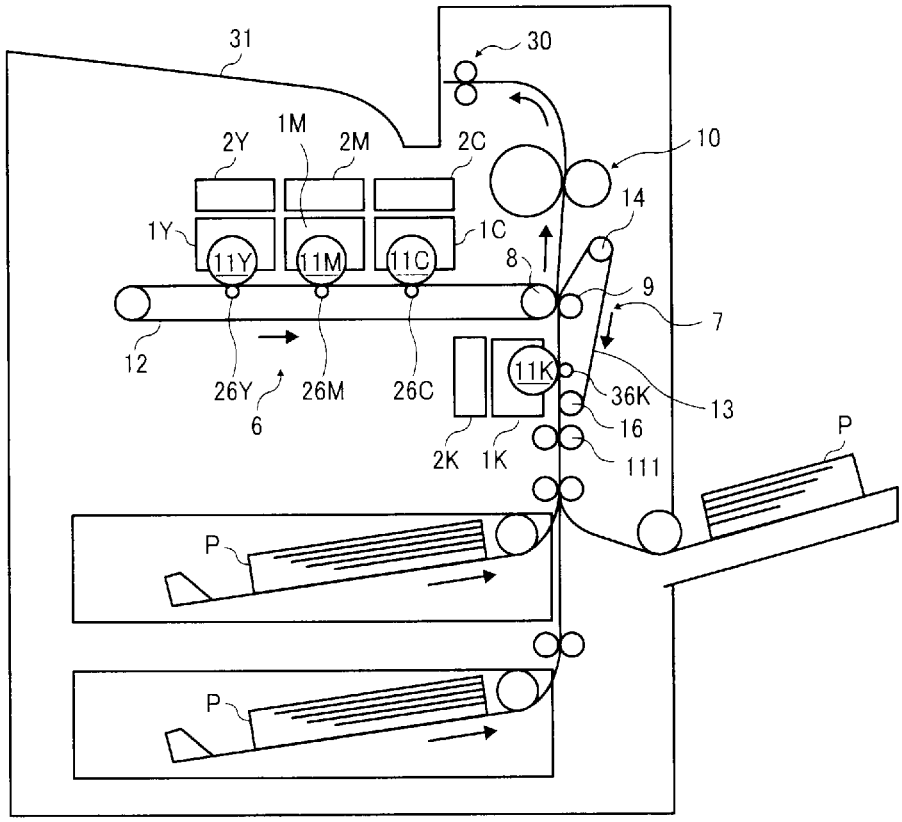
FIG. 2 is a schematic diagram illustrating a printer according to the embodiment.

FIG. 2 is a schematic diagram illustrating a printer according to the embodiment. In FIG. 2, the printer is provided with a printer section.

Figure 3:
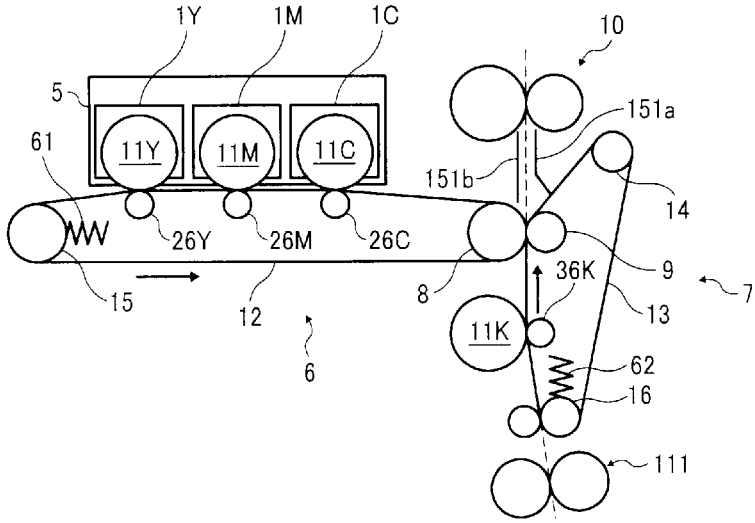
FIG. 3 is a diagram for explaining the intermediate transfer unit and the imaging unit.

The printer section has four image forming units 1Y, 1M, 1C, and 1K respectively forming a toner image in yellow, magenta, cyan, and black (hereinafter, described as Y, M, C, and K). As illustrated in FIG. 3, an intermediate transfer unit 6 in the printer section has an intermediate transfer belt 12 stretched in a position extending in the horizontal direction by a driving roller 8, a tension roller 15, and three primary transfer rollers 26Y, 26M and 26C arranged on an inner side of the belt loop. The tension roller 15 is pivotally supported to swing and is urged by a spring 61 from the inner side of the intermediate transfer belt 12 towards the outer side to give tension to the intermediate transfer belt 12. The intermediate transfer belt 12 as an image carrier is endlessly moved in the counter-clockwise direction in FIG. 3 by the rotary drive of the driving roller 8. The three image forming units 1Y, 1M, and 1C are arranged to line up along the stretched surface of the intermediate transfer belt 12.

The image forming units 1Y, 1M, 1C, and 1K are held by a common supporting body as a single unit with respective photosensitive elements 11Y, 11M, 11C, and 11K, charging units (not depicted), developing units (not depicted), and drum cleaning devices (not depicted). The charging unit uniformly charges the circumferential surface of the respective photosensitive elements 11Y, 11M, 11C, and 11K in darkness at a polarity opposite to the charging polarity of toner. The respective photosensitive elements 11Y, 11M, 11C, and 11K are rotationally driven by a driving unit not depicted. Furthermore, as depicted in FIG. 3, the image forming units 1Y, 1M, and 1C are integrated as an imaging unit 5 and each of the image forming units 1Y, 1M, and 1C is structured to be individually detachable from the imaging unit 5.

Above the image forming units 1Y, 1M, and 1C and on the left side of the image forming unit 1K, optical writing units 2Y, 2M, 2C, and 2K are arranged. The color image information sent from an external personal computer not depicted is separated into information in Y, M, C, and K in an image processing section not depicted and is then processed in the printer section. The optical writing units 2Y, 2M, 2C and 2K, with a known technology, drive light sources for Y, M, C, and K not depicted based on color-separated image information of Y, M, C, and K to generate writing light beams for Y, M, C, and K, respectively. The optical writing units 2Y, 2M, 2C and 2K scan the circumferential surfaces of the photosensitive elements 11Y, 11M, 11C, and 11K uniformly charged by the charging units with the respective writing light beams for Y, M, C, and K. This forms electrostatic latent images for Y, M, C, and K on the respective circumferential surfaces of the photosensitive elements 11Y, 11M, 11C, and 11K. The exemplary light sources of the writing light beam may include a laser diode and an LED.

The electrostatic latent images formed on the circumferential surfaces of the photosensitive elements 11Y, 11M, 11C, and 11K are developed by the developing units adopting a known two-component developing method using two-component developer composed of toner and carrier to form toner images in Y, M, C, and K. The developing unit adopting a known one-component developing method using one-component developer composed of toner may be used.

The photosensitive elements 11Y, 11M, and 11C out of four photosensitive elements form primary transfer nips for Y, M, and C abutting on the intermediate transfer belt 12. On the inner side of the loop of the intermediate transfer belt 12, the primary transfer rollers 26Y, 26M, and 26C are arranged pressing the intermediate transfer belt 12 towards the photosensitive elements 11Y, 11M, and 11C. Primary transfer bias is applied to each of the primary transfer rollers 26Y, 26M, and 26C, thereby forming transfer electric fields in the primary transfer nips for Y, M, and C. The toner images in Y, M, and C formed on the circumferential surfaces of the photosensitive elements 11Y, 11M, and 11C are transferred onto a front surface (outer surface of the loop) of the intermediate transfer belt 12 overlapping one on top of the other at the respective primary transfer nips for Y, M, and C by the action of the transfer electric field and nip pressure. Consequently, on the front surface of the intermediate transfer belt 12, a toner image in three colors overlapping one on top of the other is formed.

On the right side of the intermediate transfer belt 12 in FIG. 3, a direct transfer unit 7 is arranged. The direct transfer unit 7 has an endless direct transfer belt 13. The direct transfer belt 13 is stretched in a vertically long position by a secondary transfer roller 9, a driving roller 14, a tension roller 16, and a transfer roller 36K for K color and is endlessly moved in the clockwise direction in FIG. 3 by the rotary drive of the driving roller 14. The tension roller 16 is pivotally supported to swing and is urged by a spring 62 from the inner side of the direct transfer belt 13 towards the outer side to give tension to the direct transfer belt 13. A portion of the direct transfer belt 13 on the secondary transfer roller 9 is abutted on a portion of the intermediate transfer belt 12 on the driving roller 8 to form a secondary transfer nip. Secondary transfer bias is applied to the secondary transfer roller 9, thereby forming a transfer electric field in the secondary transfer nip. A portion of the direct transfer belt 13 being on the transfer roller 36K for K is abutted on the photosensitive element 11K for K to form a direct transfer nip for K. Transfer bias is applied also to the transfer roller 36K, similarly to the primary transfer rollers 26Y, 26M, and 26C, thereby forming a transfer electric field in the direct transfer nip for K.

In the lower part of the housing of the printer unit, a first paper cassette 3 and a second paper cassette 4 are arranged in a manner stacked in a vertical direction. Each of the paper cassettes feeds recording sheets P stored therein out to a sheet conveying path. The recording sheet P thus fed abuts against a pair of registration rollers 111 which are arranged in the sheet conveying path extending in the vertical direction in the printer unit so as to have the skew thereof corrected; and the recording sheet P is nipped between the registration rollers 111. The registration rollers 111 then convey the recording sheet P to the higher position at a predetermined operational timing.

The recording sheet P conveyed out of the registration rollers 111 sequentially passes through the direct transfer nip for K and then the secondary transfer nip for Y, M, and C formed along the sheet conveying path. As the recording sheet P passes through the direct transfer nip for K, the K toner image formed on the circumferential surface of the photosensitive element 11K is transferred onto the recording sheet P by the actions of the transfer electrical field and the pressure in the nip. As the recording sheet P passes through the secondary transfer nip subsequently, a three-color (Y, M, and C) superimposed toner image formed on the intermediate transfer belt 12 is altogether secondarily transferred onto the K toner image that is previously transferred onto the recording sheet P by the actions of the transfer electrical field and the pressure in the nip. In this manner, a full-color image that is a four-color superimposed toner image of Y, M, C, and K is formed on the surface of the recording sheet P.

The transfer residual toner adhered on the surfaces of the photosensitive elements 11Y, 11M, 11C, and 11K after passing the primary transfer nips for Y, M, and C and the direct transfer nip for K is removed by the drum cleaning devices. The drum cleaning devices for Y, M, C, and K used may be of a type that scrapes off the toner with a cleaning blade, a type that scrapes off the toner with a fur brush roller, a magnetic brush cleaning type, or the like.

Above the secondary transfer nip, a fixing unit 10 that forms a fixing nip by the abutment of a heating roller and a pressing roller is arranged. A recording sheet P, after passing the secondary transfer nip, is sent to the fixing nip in the fixing unit 10, and therein fixing process of fixing a full color image onto the recording sheet P by heat and pressure is carried out. The positional relation of the secondary transfer nip and the fixing nip of the fixing unit 10 is set such that the recording sheet P is conveyed from the secondary transfer nip to the fixing unit 10 in a straight line. Thereafter, the recording sheet P passes a discharging path through a pair of discharging rollers 30 to be discharged to and stacked in a discharge tray 31 provided on the top side of a printer housing.

In the present printer, in monochrome mode in which a monochrome image is formed, the photosensitive element 11K for K is optically scanned by the optical writing unit 2K based on image data in monochrome sent from an external personal computer not depicted, and the electrostatic latent image for K thus formed is developed by the developing unit for K to develop a toner image in K. The toner image in K is directly transferred onto the recording sheet P at the direct transfer nip for K and then, fixed onto the recording sheet P by the fixing unit 10.

Forming a monochrome image while suspending the driving of the image forming units 1Y, 1M, and 1C and the intermediate transfer belt 12 allows the wear and tear of the image forming units 1Y, 1M, and 1C (photosensitive elements 11Y, 11M, and 11C), the intermediate transfer belt 12, and the like by an unnecessary driving to be avoided, thus extending the life of these elements.

In the monochrome mode, because the toner image in K is directly transferred from the image forming unit 1K onto the recording sheet P sent from a pair of registration rollers 111 and sent to the direct transfer nip for K by the direct transfer belt 13, the image forming unit 1K for K is also arranged to line up along the stretched surface of the intermediate transfer belt 12, in addition to the image forming units 1Y, 1M, and 1C. This makes it possible to realize faster printing than the structure in which the toner image in K is transferred onto the recording sheet P at the secondary transfer nip via the intermediate transfer belt 12.

The printer of a first embodiment is structured with a later described displacement mechanism 160 (refer to FIGS. 4A and 4B) that displaces the secondary transfer roller 9 enabling it to move between the contact position and the separate position. The contact position is the position where the direct transfer belt 13 is brought into contact with the intermediate transfer belt 12 as indicated by a broken line in FIG. 1, and the separate position is the position where the direct transfer belt 13 is separated from the intermediate transfer belt 12 as indicated by a solid line in FIG. 1.

In full color mode in which images in Y, M, C, and K are formed on the recording sheet P, the secondary transfer roller 9 is positioned at the contact position to bring the direct transfer belt 13 into contact with the intermediate transfer belt 12 to form the secondary transfer nip. In the monochrome mode, the secondary transfer roller 9 is positioned at the separate position to separate the direct transfer belt 13 from the intermediate transfer belt 12. Separating the direct transfer belt 13 from the intermediate transfer belt 12 in the monochrome mode in this way makes the recording sheet P supported and conveyed by the direct transfer belt 13 not to contact the intermediate transfer belt 12. Accordingly, compared with the case that the intermediate transfer belt 12 and the direct transfer belt 13 are constantly in contact with each other, the degradation of the intermediate transfer belt 12 can be reduced, and thus the life of the intermediate transfer belt 12 can be extended.

The operational timing of displacing the secondary transfer roller 9 from the contact position to the separate position to separate the direct transfer belt 13 from the intermediate transfer belt 12 is after stopping the driving of the intermediate transfer unit 6 including the photosensitive elements 11Y, 11M, and 11C, the image forming units 1Y, 1M, and 1C, the primary transfer rollers 26Y, 26M, and 26C, the driving roller 8, the tension roller 15, the intermediate transfer belt 12, and the like, and the direct transfer belt 13 and the like.

Alternatively, it is possible to configure the intermediate transfer belt 12 so that the intermediate transfer belt 12 is moved relative to, and separated from, the direct transfer belt 13. However, such configuration is not desirable because, compared with the structure separating the direct transfer belt 13 from the intermediate transfer belt 12 by displacing the secondary transfer roller 9 from the contact position to the separate position, in other words, moving the secondary transfer roller 9 in the direction separating away from the intermediate transfer belt 12 as in the present embodiment, it requires many components to be moved and the size of the unit to be moved is larger, whereby a large moving space is required.

Figure 4A:
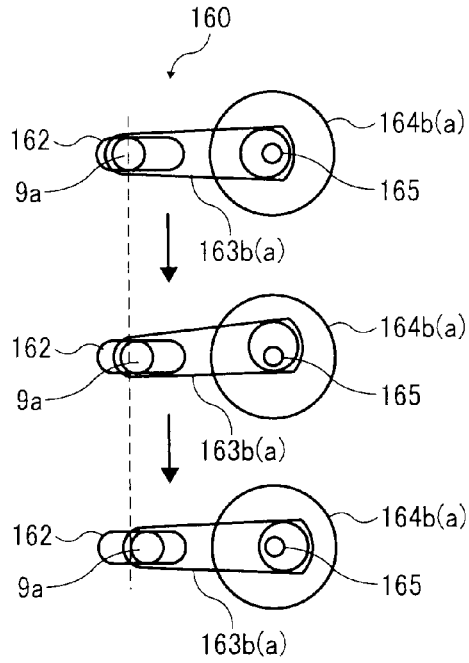
FIGS. 4A and 4B are diagrams for explaining a method of separating a secondary transfer roller.
Figure 4B:
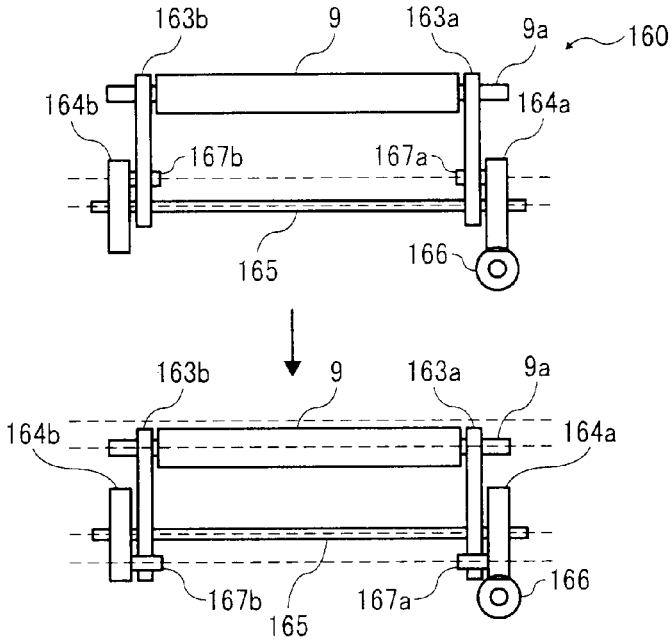

With reference to FIGS. 4A and 4B, the displacement mechanism 160 that displaces the secondary transfer roller 9 will be explained. FIG. 4A is a diagram for explaining the displacement mechanism 160 viewed from an axial direction of the secondary transfer roller 9 and FIG. 4B is a diagram for explaining the displacement mechanism 160 viewed from the top.

Both ends of a shaft 9*a* of the secondary transfer roller 9 are supported by respective links 163*a* and 163*b* that are elongated in a displacing direction of the secondary transfer roller 9. As depicted in FIG. 4A, arranged are shaft guides 162 that support the shaft 9*a* with slotted holes elongated in the displacing direction of the secondary transfer roller 9 and regulate the moving direction of the shaft 9*a*. The links 163*a* and 163*b* are fitted with protrusion portions 167*a* and 167*b*, respectively, arranged in a position eccentric with respect to a rotating shaft 165 of an eccentric gear 164*a* and of an eccentric pulley 164*b* provided to the apparatus body.

The eccentric gear 164*a* receives a driving force transmitted by a worm gear 166. The eccentric gear 164*a* rotates by the rotation of the worm gear 166, as indicated in FIGS. 4A and 4B. Linked to the rotation of the eccentric gear 164*a* transmitted via the rotation shaft 165, the eccentric pulley 164*b* also rotates. By the rotation of the eccentric gear 164*a* and the eccentric pulley 164*b* in this manner, the link 163*a* is pulled from the secondary transfer roller 9 side towards the eccentric gear 164*a* side and the link 163*b* is pulled from the secondary transfer roller 9 side towards the eccentric pulley 164*b* side, whereby the secondary transfer roller 9 can be moved from the contact position to the separate position with the moving direction of the shaft 9*a* being regulated by the shaft guides 162.

The displacement mechanism that displaces the secondary transfer roller 9 illustrated in FIGS. 4A and 4B is merely an example and therefore, the present invention is not limited to this, and any of known mechanisms can be used.

Figure 1:
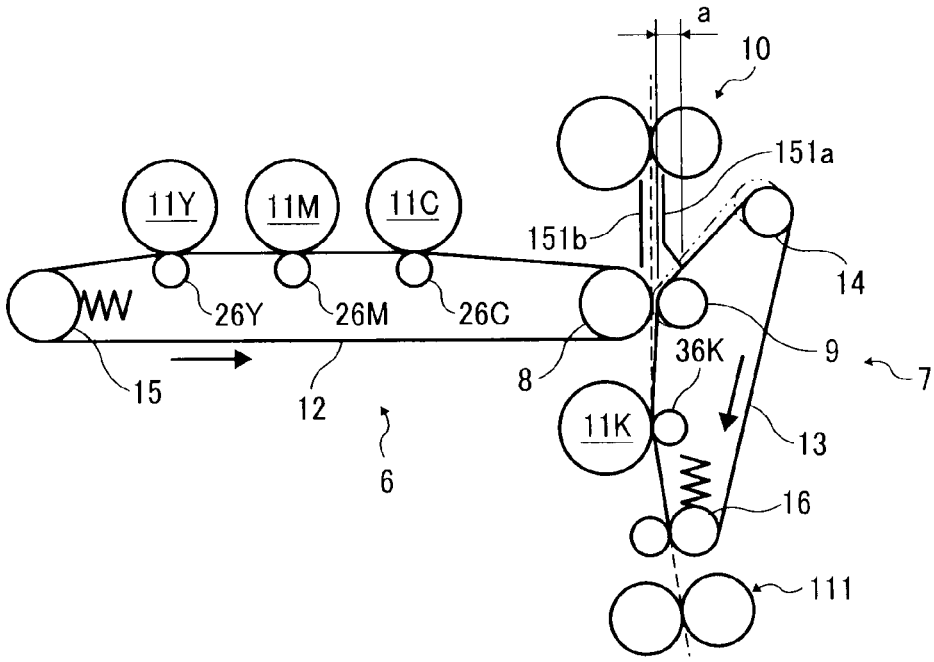
FIG. 1 is a diagram for explaining an intermediate transfer unit and an imaging unit according to a first embodiment of the present invention.

In the first embodiment, as depicted in FIG. 1, on the downstream side of the secondary transfer position in the recording sheet conveying direction, a guide plate 151*b* arranged on the intermediate transfer belt 12 side and a guide plate 151*a* arranged on the secondary transfer roller 9 side are structured to guide the recording sheet P to the fixing unit 10 as the recording sheet P is separated from the direct transfer belt 13 and conveyed towards the fixing unit 10. Accordingly, when the direct transfer belt 13 is separated from the intermediate transfer belt 12, even if the recording sheet P is conveyed along the direct transfer belt 13, the leading edge of the recording sheet P is scooped up by the upstream end of the guide plate 151*a* and guided in the recording sheet conveying direction. This makes it possible to deliver the recording sheet P from the direct transfer belt 13 to the guide plate 151*a*, thereby reliably conveying the recording sheet P to the fixing unit 10.

In addition, it is desirable to reliably deliver the recording sheet P from the direct transfer belt 13 to the guide plate 151*a* even when the direct transfer belt 13 is separated from the intermediate transfer belt 12. Hence, a contact portion between the inner circumferential surface of the direct transfer belt 13 and the secondary transfer roller 9 is positioned in such a manner that, when the secondary transfer roller 9 is moved from the contact position to the separate position, the contact portion comes to a position close to the center of a recording sheet conveying path in the width direction, more specifically, to the center in the width direction of the recording sheet conveying path through which the recording paper is conveyed from the secondary transfer nip towards the upstream end of the guide plate 151*a* in the recording paper conveying direction up to the fixing unit 10 when the secondary transfer roller 9 is in the contact position, or the recording sheet conveying path formed by the guide plates 151*a* and 151*b*. In this case, a distance between the position of the contacting portion of the inner surface of the direct transfer belt 13 with the secondary transfer roller 9 and the position of the upstream end of the guide plate 151*a* in the recording sheet conveying direction (position where the guide plate 151*a* scoops up the recording sheet P) is defined as a distance "a" and, the distance "a" is desirable to be set as large as possible. At least, a distance of about three millimeters should be normally secured.

Figure 5:
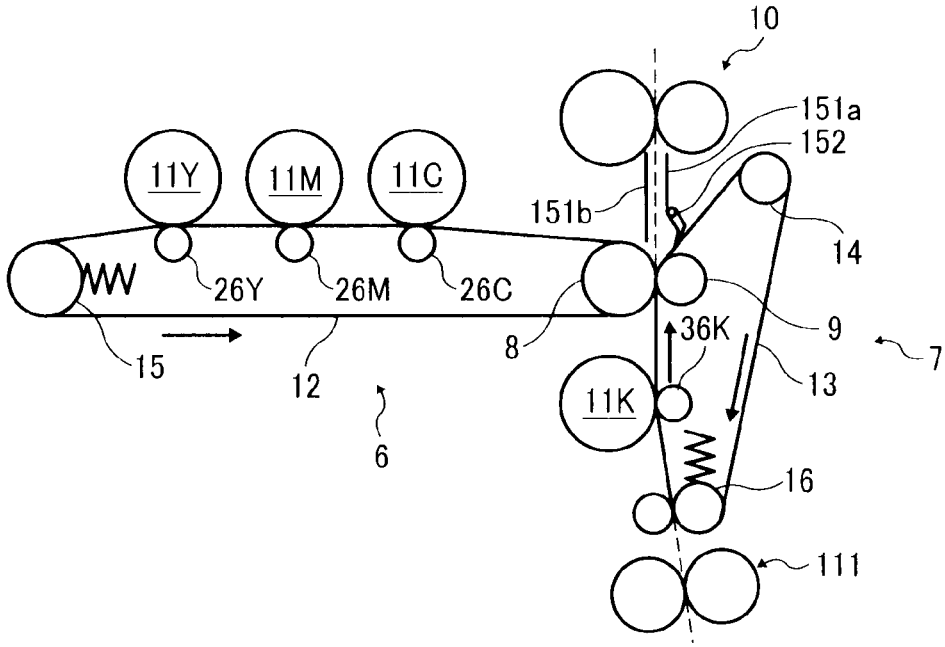
FIG. 5 is a schematic diagram indicating the state of the secondary transfer roller being brought into contact with an intermediate transfer belt.
Figure 6:
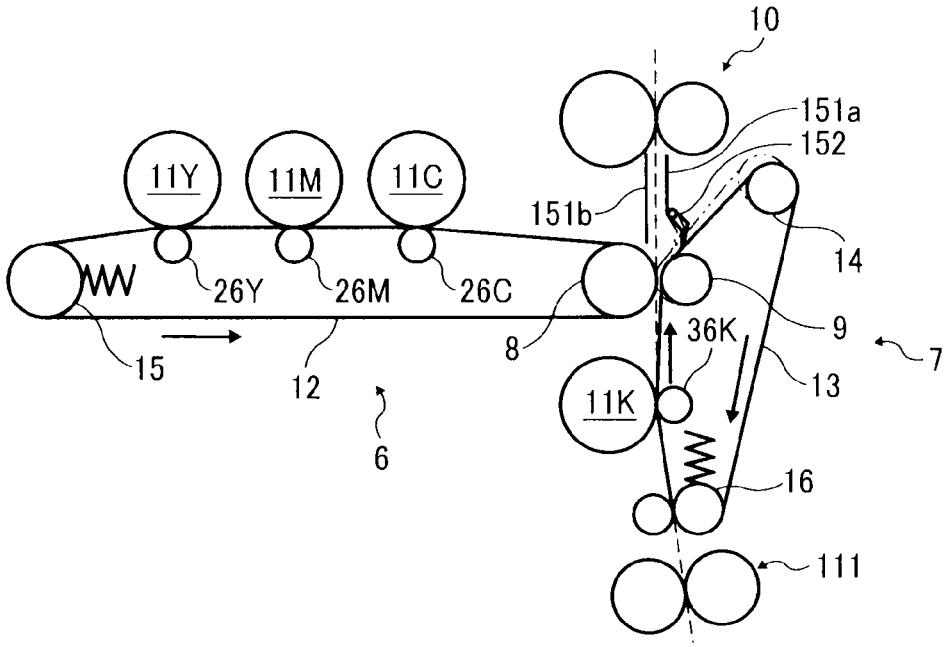
FIG. 6 is a schematic diagram indicating the state of the secondary transfer roller being separated from the intermediate transfer belt.

FIG. 5 is a schematic diagram indicating the state of the direct transfer belt 13 being brought into contact with the intermediate transfer belt 12, and FIG. 6 is a schematic diagram indicating the state of the direct transfer belt 13 being separated from the intermediate transfer belt 12. In a second embodiment, the displacement mechanism 160 explained in the first embodiment is also used as a displacement unit to displace the secondary transfer roller 9 between the contact position and the separate position.

In the second embodiment, as depicted in FIG. 5, a delivery member 152 the trailing edge of which is pivotally supported at the upstream end of the guide plate 151*a* in the recording sheet conveying direction is arranged such that the leading edge of the delivery member 152 contacts the front surface of the direct transfer belt 13. By way of example, a bifurcating claw or the like may be employed as the delivery member 152.

The leading edge of the recording sheet P supported and conveyed by the direct transfer belt 13, when reaching the leading edge of the delivery member 152, is scooped up from the direct transfer belt 13 by the delivery member 152 and delivered to the guide plate 151*a*.

It is desirable that the delivery member 152 be structured to be pivotable to a given position, and the pivoting timing of the delivery member 152 be synchronized with the operational timing of displacement of the secondary transfer roller 9. The delivery member 152 may be structured to be rotationally driven by a separately provided independent drive source, or may be structured to rotate following the movement of the direct transfer belt 13 which moves as the secondary transfer roller 9 is displaced. In this case, the delivery member 152 may stay in contact with the front surface of the direct transfer belt 13 during rotation.

Furthermore, as depicted in FIG. 6, the contact position and the contact angle of the leading edge of the delivery member 152 coming in contact with the front surface of the direct transfer belt 13 when the direct transfer belt 13 is separated from the intermediate transfer belt 12 are set equivalent to those of when the direct transfer belt 13 is brought into contact with the intermediate transfer belt 12 as depicted in FIG. 5. As a consequence, even when the direct transfer belt 13 is separated from the intermediate transfer belt 12, the deliverability of the recording sheet P from the direct transfer belt 13 to the guide plate 151*a* by the delivery member 152 is not degraded, whereby the stable conveyance of the recording sheet P can be ensured regardless of the direct transfer belt 13 being brought into contact with or separated from the intermediate transfer belt 12.

Figure 7:
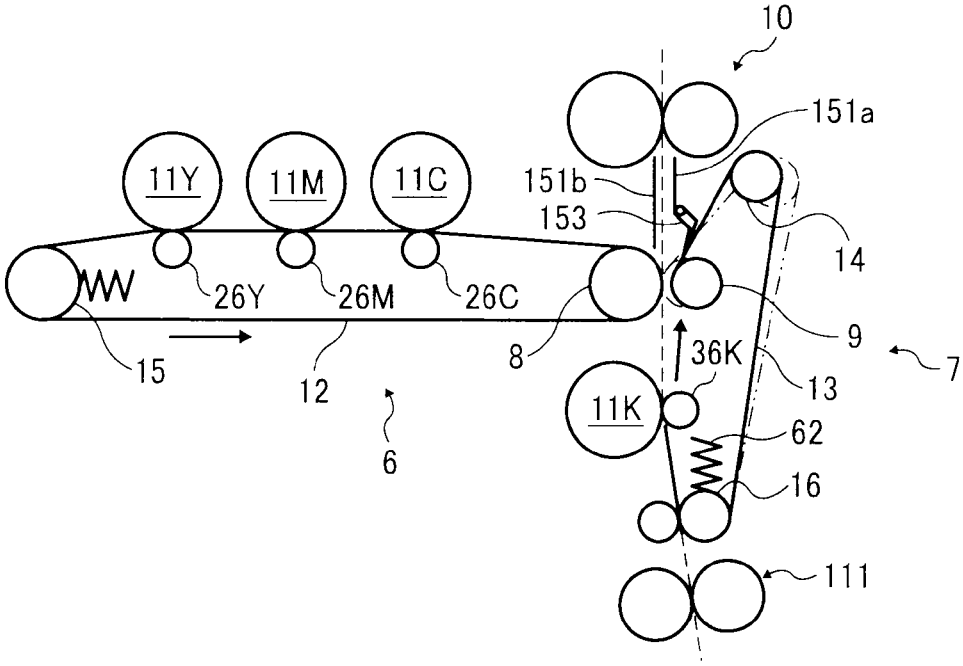
FIG. 7 is a schematic diagram indicating the state of the secondary transfer roller being separated from the intermediate transfer belt.

In a third embodiment, a trailing edge of a delivery member 153 depicted in FIG. 7 is fixedly provided on the upstream end of the guide plate 151*a* in the recording sheet conveying direction. In the third embodiment, the displacement mechanism 160 explained in the first embodiment is also used as a displacement unit to displace the secondary transfer roller 9 between the contact position and the separate position. Furthermore, in the third embodiment, the driving roller 14 is provided to be displaceable by a similar displacement mechanism to the secondary transfer roller 9 described in the foregoing. While the shaft guides 162 that regulate the moving direction of the shaft 9*a* of the secondary transfer roller 9 are arranged as described above, as indicated in FIG. 8, shaft guides 161 that regulate the moving direction of the shaft for the driving roller 14 are also arranged. If it is difficult to move the shaft of the driving roller 14, a displaceable roller member that stretches the direct transfer belt 13 between the secondary transfer roller 9 and the driving roller 14 in the rotational direction of the direct transfer belt 13 may be arranged separately. It is also possible to make the tension roller 16 displaceable.

The positions of the secondary transfer roller 9 and the driving roller 14 when the direct transfer belt 13 is brought into contact with the intermediate transfer belt 12 and the positions of the secondary transfer roller 9 and the driving roller 14 when the direct transfer belt 13 is separated from the intermediate transfer belt 12 are set such that the whole circumference of the direct transfer belt 13 when the direct transfer belt 13 is brought into contact with the intermediate transfer belt 12 is equivalent to the whole circumference of the direct transfer belt 13 when the direct transfer belt 13 is separated from the intermediate transfer belt 12.

When the direct transfer belt 13 is separated from the intermediate transfer belt 12, because of the delivery member 153 being fixed to the guide plate 151*a*, there is a possibility of the leading edge of the delivery member 153 not coming in contact with the front surface of the direct transfer belt 13, whereby the delivery performance of the recording sheet P from the direct transfer belt 13 to the guide plate 151*a* by the delivery member 153 may deteriorate.

Therefore, the driving roller 14 is moved in the direction opposite to the moving direction of the secondary transfer roller 9, so that a path of the direct transfer belt 13 between the secondary transfer roller 9 and the driving roller 14 is rotated around the point where the leading edge of the delivery member 153 touches the front surface of the direct transfer belt 13.

Accordingly, on the path of the direct transfer belt 13, the contact position of the leading edge of the delivery member 153 with the front surface of the direct transfer belt 13 does not change when the position of the direct transfer belt 13 is changed from the contact position where the direct transfer belt 13 is in contact with the intermediate transfer belt 12 to the separated position where the direct transfer belt 13 is separated from the intermediate transfer belt 12. Consequently, the leading edge of the delivery member 153 is kept in contact with the front surface of the direct transfer belt 13 regardless of the contact/separation between the direct transfer belt 13 and the intermediate transfer belt 12. This allows the stable conveyance of the recording sheet P to be ensured without deteriorating the delivery performance of the recording sheet P from the direct transfer belt 13 to the guide plate 151*a* by the delivery member 153.

Figure 8:
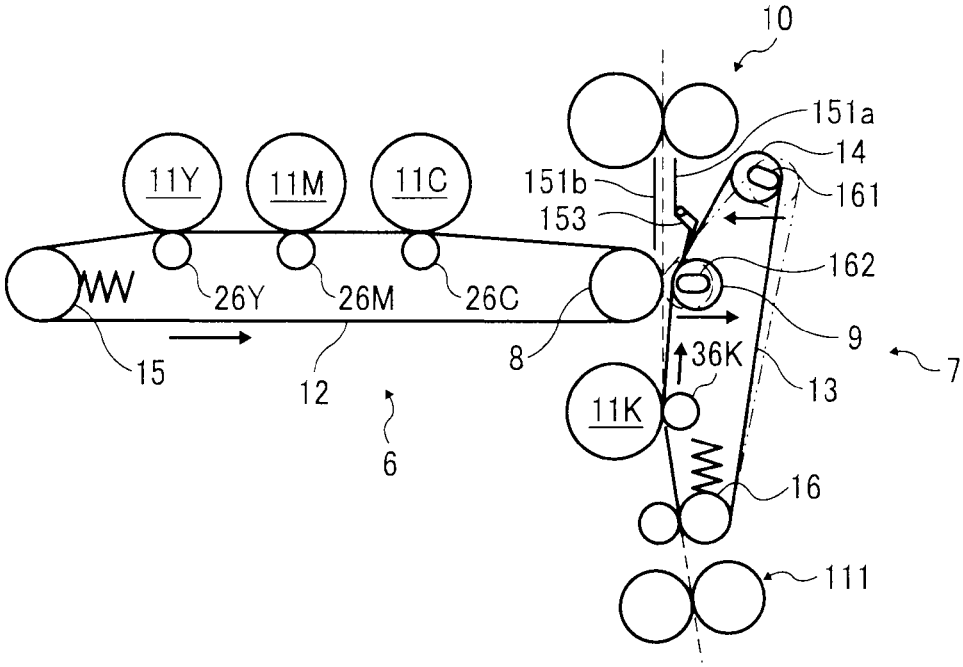
FIG. 8 is a diagram for explaining a method of separating a direct transfer belt.

As depicted in FIG. 8, by providing the delivery member 153 in such a way that the contact position of the leading edge of the delivery member 153 with the front surface of the direct transfer belt 13 is positioned at the position closer to the secondary transfer roller 9 than the driving roller 14 in the rotational direction of the direct transfer belt, the deliverability is enhanced.

In the first to third embodiments, the image forming unit 1K for K is arranged on the upstream side of the secondary transfer nip in the recording sheet conveying direction. However, even when the image forming unit 1K is arranged on the downstream side of the secondary transfer nip in the recording sheet conveying direction, it is possible to suppress the degradation of the intermediate transfer belt 12 and extend the life of the intermediate transfer belt 12 as compared with the case where the intermediate transfer belt 12 is constantly in touch with the direct transfer belt 13, by preventing the recording paper P supported and conveyed by the direct transfer belt 13 from touching the intermediate transfer belt 12 by moving the secondary transfer roller 9 to the separated position by the displacement mechanism 160 and separating the intermediate transfer belt 12 from the direct transfer belt 13.

Further, because the direct transfer belt 13 supports and conveys the recording paper P while the recording paper passes through the direct transfer nip and the secondary transfer nip, the direct transfer belt 13 can make the recording paper P pass through the direct transfer nip and the secondary transfer nip irrespective of the position of the direct transfer nip relative to the secondary transfer nip, i.e., no matter whether the direct transfer nip is on upstream side or on downstream side of the secondary transfer nip in the recording paper conveying direction. Hence, the degree of freedom in printer components layout would not be lowered. For example, it is not necessary to arrange the direct transfer nip on the downstream side of the secondary transfer nip in the recording paper conveying direction.

In the printer according to the first to third embodiments, while the photosensitive elements 11Y, 11M, and 11C are exemplified to be positioned above the intermediate transfer belt 12, the photosensitive elements 11Y, 11M, and 11C may be positioned below the intermediate transfer belt 12. The image forming units 1 (photosensitive elements 11) facing the intermediate transfer belt 12 may be a single unit.

The distance between the secondary transfer position and the direct transfer position when the secondary transfer roller 9 is positioned at the contact position by the displacement mechanism 160 so as to bring the direct transfer belt 13 into contact with the intermediate transfer belt 12 is desirable to be obtained from multiplication, by a positive integer, of the circumferential length of the roller member that is one of the multiple roller members stretching the direct transfer belt 13 and causes the speed fluctuation of the direct transfer belt 13. By obtaining the distance from multiplication of the circumferential length of the roller member that causes speed fluctuation of the direct transfer belt 13, e.g., the driving roller 14, by a positive integer, the phases of the speed fluctuation arising at the direct transfer position and at the secondary transfer position in one rotation cycle of the driving roller 14 can be matched. Accordingly, the phases of the speed fluctuation of the recording sheet P supported and conveyed by the direct transfer belt 13 arising at the direct transfer position and at the secondary transfer position in one rotation cycle of the driving roller 14 can also be matched. As a consequence, the influence of the speed fluctuation arising at the direct transfer position and at the secondary transfer position in one rotation cycle of the driving roller 14 with respect to the conveying speeds of the recording sheet P can be negated. Therefore, the positional deviation between the images transferred on the recording sheet P at the direct transfer position and at the secondary transfer position attributed to the speed fluctuation in one rotational cycle of the driving roller 14 can be prevented from arising.

According to the embodiments as described in the foregoing, the image forming apparatus is provided with the intermediate transfer belt 12 rotatably stretched across a plurality of roller members, the photosensitive elements 11Y, 11M, and 11C as first image carriers arranged facing the front surface of the intermediate transfer belt 12, the image forming units 1Y, 1M, and 1C as first image forming units that form images on the photosensitive elements 11Y, 11M, and 11C, the primary transfer rollers 26Y, 26M, and 26C as primary transfer units that primary transfer the images formed on the photosensitive elements 11Y, 11M, and 11C onto the intermediate transfer belt 12, the secondary transfer roller 9 that is arranged facing the front surface of the intermediate transfer belt 12 and secondarily transfers the images transferred on the intermediate transfer belt 12 onto the recording sheet P as a recording medium, the photosensitive element 11K as a second image carrier provided on the upstream or the downstream of the secondary transfer position where the images are secondarily transferred from the intermediate transfer belt 12 onto the recording sheet P in a recording sheet conveying direction, the image forming unit 1K as a second image forming unit that forms an image on the photosensitive element 11K, the transfer roller 36K as a direct transfer unit that directly transfers the image formed on the photosensitive element 11K onto the recording sheet P, and the direct transfer belt 13 as a recording medium carriage belt that is rotatably stretched across a plurality of roller members including the secondary transfer roller 9 and supports and conveys the recording sheet P so as to pass it through the direct transfer position where the image is directly transferred from the photosensitive element 11K onto the recording sheet P and the secondary transfer position, and further has the displacement mechanism 160 as a displacement unit that displaces the secondary transfer roller 9 to be movable between the contact position where the direct transfer belt 13 is brought into contact with the intermediate transfer belt 12 and the separate position where the direct transfer belt 13 is separated from the intermediate transfer belt 12 retracting from the contact position. This allows, by moving the secondary transfer roller 9 from the contact position to the separate position by the displacement mechanism 160, the direct transfer belt 13 to be separated from the intermediate transfer belt 12. Consequently, when an image is formed on the recording sheet P only by the photosensitive element 11K as in the monochrome mode and the like, by moving the secondary transfer roller 9 from the contact position to the separate position by the displacement mechanism 160 to separate the direct transfer belt 13 from the intermediate transfer belt 12, the recording sheet P supported by the direct transfer belt 13 can be conveyed without being brought into contact with the intermediate transfer belt 12. This reduces the contact of the recording sheet P with the intermediate transfer belt 12 compared with the case that the direct transfer belt 13 is constantly brought into contact with the intermediate transfer belt 12, thereby allowing the degradation of the intermediate transfer belt 12 to be reduced and the life of the intermediate transfer belt 12 to be extended.

According to the embodiment, the photosensitive element 11K is provided on the upstream side of the secondary transfer position in the recording sheet conveying direction, and the secondary transfer position is positioned on the downstream side of the direct transfer position in the recording sheet conveying direction. Furthermore, the fixing unit 10 as a fixing unit that is provided on the downstream side of the secondary transfer position in the recording sheet conveying direction and fixes an image transferred onto the recording sheet P onto the recording sheet P, and the guide plate 151*a* as a guide member that guides the recording sheet P separated from the direct transfer belt 13 on the downstream side of the secondary transfer position in the recording sheet conveying direction to the fixing unit 10 are provided. This makes it possible, when the direct transfer belt 13 is separated from the intermediate transfer belt 12, to deliver the recording sheet P from the direct transfer belt 13 to the guide plate 151*a* even when the recording sheet P is conveyed along the direct transfer belt 13 because the leading edge of the recording sheet P is scooped up by the downstream end of the guide plate 151*a* in the recording sheet conveying direction, thereby allowing the recording sheet P to be reliably conveyed to the fixing unit 10.

According to the embodiment, when the secondary transfer roller 9 is displaced from the contact position to the separate position by the displacement mechanism 160, the contacting portion of the inner circumferential surface of the direct transfer belt 13 with the secondary transfer roller 9 is positioned at the position close to the recording sheet conveying path in which the recording sheet P is conveyed from the secondary transfer position to the fixing unit 10 when the secondary transfer roller 9 is positioned at the contact position with respect to the upstream end of the guide plate 151*a* in the recording sheet conveying direction. Accordingly, the delivery of the recording sheet P from the direct transfer belt 13 to the guide plate 151*a* can be reliably carried out.

According to the embodiment, the fact that the delivery member 152 provided to the guide plate 151*a* is movably provided in response to the position of the secondary transfer roller 9 displaced by the displacement mechanism 160 makes the deliverability of the recording sheet P from the direct transfer belt 13 to the guide plate 151*a* not to be degraded even when the direct transfer belt 13 is separated from the intermediate transfer belt 12, thereby allowing the stable conveyance of the recording sheet P to be ensured regardless of the direct transfer belt 13 being brought into contact with or separated from the intermediate transfer belt 12.

According to the embodiment, the fact that the leading edge of the delivery member 153 provided to the guide plate 151*a* is in contact with the front surface of the direct transfer belt 13 when the secondary transfer roller 9 is positioned at the contact position and the contact of the leading edge of the delivery member 153 with the front surface of the direct transfer belt 13 is maintained when the secondary transfer roller 9 is displaced from the contact position to the separate position by the displacement mechanism 160 allows the stable conveyance of the recording sheet P to be ensured without deteriorating the delivery performance of the recording sheet P from the direct transfer belt 13 to the guide plate 151*a* by the delivery member 153.

According to the embodiment, the driving roller 14 that is one or more of the other roller members different from the secondary transfer roller 9 out of the multiple roller members stretching the direct transfer belt 13 is movably provided and, when the secondary transfer roller 9 is displaced from the contact position to the separate position by the displacement mechanism 160, the movable one or more of the roller members such as the driving roller 14 are moved in nearly the opposite direction to the moving direction of the secondary transfer roller 9. Accordingly, the contact position of the leading edge of the delivery member 153 with the front surface of the direct transfer belt 13 can be positioned at the position where the rotational path of the direct transfer belt 13 does not fluctuate between when the direct transfer belt 13 is brought into contact with the intermediate transfer belt 12 and when the direct transfer belt 13 is separated from the intermediate transfer belt 12. Consequently, the contact of the leading edge of the delivery member 153 with the front surface of the direct transfer belt 13 can be maintained regardless of the direct transfer belt 13 being brought into contact with or separated from the intermediate transfer belt 12.

According to the embodiments, it is desirable that the secondary transfer roller 9 be displaced from the contact position to the separate position by the displacement mechanism 160 after the drive for the photosensitive elements 11Y, 11M, and 11C, the image forming units 1Y, 1M, and 1C, the primary transfer rollers 26Y, 26M, and 26C, the intermediate transfer belt 12, and the driving roller 8 and the tension roller 15 as a plurality of roller members stretching the intermediate transfer belt 12 is stopped. This makes it possible to shift from the full color mode to the monochrome mode in the state that the drive for the image forming units 1Y, 1M, and 1C and the intermediate transfer belt 12 is stopped, thereby allowing the wear and tear of the image forming units 1Y, 1M, and 1C (photosensitive elements 11Y, 11M, and 11C), the intermediate transfer belt 12, and the like to be avoided by the unnecessary drive and thus, extending the life.

According to one aspect of the embodiment of the present invention, by displacing the secondary transfer roller from the contact position to a separate position by the displacement unit, the recording medium carriage belt can be separated from the intermediate belt. Accordingly, when forming the image on the recording medium with only the second image carrier or in other cases, by displacing the secondary transfer belt from the contact position to the separate position by the displacement unit to separate the recording medium carriage belt from the intermediate transfer belt, the recording medium supported by the recording medium carriage belt can be conveyed without being brought into contact with the intermediate transfer belt. Consequently, compared with the case that the recording medium carriage belt is constantly brought into contact with the intermediate transfer belt, the contact of the recording medium with the intermediate transfer belt is reduced, whereby the degradation of the intermediate transfer belt can be reduced and thus the life of the intermediate transfer belt can be extended.

As described above, according to one aspect of the embodiment of the present invention, the degradation of the intermediate transfer belt can be reduce and the life of the intermediate transfer belt can be extended.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an intermediate transfer belt rotatably stretched across a first plurality of roller members;

a first image carrier arranged facing a front surface of the intermediate transfer belt;

a first image forming unit that forms an image on the first image carrier;

a primary transfer unit that primarily transfers the image formed on the first image carrier onto the intermediate transfer belt;

a secondary transfer roller that is arranged facing the front surface of the intermediate transfer belt and secondarily transfers the image transferred on the intermediate transfer belt onto a recording medium;

a second image carrier provided on an upstream side or a downstream side of a secondary transfer position in a recording medium conveying direction, the secondary transfer position being a position where an image is secondarily transferred from the intermediate transfer belt onto the recording medium;

a second image forming unit that forms an image on the second image carrier;

a direct transfer unit that directly transfers an image formed on the second image carrier onto the recording medium;

a recording medium carriage belt that is rotatably stretched across a second plurality of roller members including the secondary transfer roller and supports and conveys the recording medium so as to pass the recording medium through a direct transfer position and the secondary transfer position, the direct transfer position being a position where the image is directly transferred from the second image carrier onto the recording medium; and a first displacement unit that displaces the secondary transfer roller in a movable manner between a contact position and a separate position, the contact position being a position where the recording medium carriage belt is brought into contact with the intermediate transfer belt and the separate position being a position where the recording medium carriage belt is separated from the intermediate transfer belt retracting from the contact position, wherein the first displacement unit includes a first shaft disposed through a longitudinal axis of the secondary transfer roller, opposite ends of the first shaft extending beyond a longitudinal length of the secondary transfer roller;

a pair of elongated links, each of the elongated links supporting one of the opposite ends of the first shaft;

a second shaft arranged substantially parallel to the first shaft;

a pair of shaft guides separate from the elongated links, the pair of shaft guides including slotted holes elongated in a first direction, the first direction extending perpendicular to an axis of the first shaft toward the second shaft, each of the slotted holes supporting one of the opposite ends of the first shaft; and an eccentric gear coupled to the second shaft, the eccentric gear coupled to one of the pair of elongated links via a protrusion portion, and rotation of the eccentric gear displaces the first shaft in the first direction.

2. The image forming apparatus according to claim 1, wherein the second image carrier is provided on the upstream side of the secondary transfer position in the recording medium conveying direction, and the secondary transfer position is positioned on the downstream side of the direct transfer position in the recording medium conveying direction, and the image forming apparatus further comprises:

a fixing unit that is provided on the downstream side of the secondary transfer position in the recording medium conveying direction and fixes an image transferred onto the recording medium to the recording medium, and a guide member that guides the recording medium separated from the recording medium carriage belt on the downstream side of the secondary transfer position in the recording medium conveying direction to the fixing unit.

3. The image forming apparatus according to claim 2, wherein:

a contacting portion between an inner circumferential surface of the recording medium carriage belt and the secondary transfer roller in the separate position is closer to a recording medium conveying path than to an upstream end of the guide member, and the recording medium conveying path extends through a point on the outer surface of the intermediate transfer belt at the secondary transfer position to the fixing unit.

4. The image forming apparatus according to claim 2, wherein the guide member moves as the secondary transfer roller is displaced by the first displacement unit.

5. The image forming apparatus according to claim 2, wherein an upstream end of the guide member is in contact with a front surface of the recording medium carriage belt when the secondary transfer roller is in the contact position, and the upstream end of the guide member stays in contact with the front surface of the recording medium carriage belt while the first displacement unit displaces the secondary transfer roller from the contact position to the separate position.

6. The image forming apparatus according to claim 5, wherein:

in addition to the secondary transfer roller, at least one of the roller members, on which the recording medium carriage belt is placed, is movable, and the at least one roller member moves in a substantially opposite direction from the direction of movement of the secondary transfer roller when the first displacement unit displaces the secondary transfer roller from the contact position to the separate position.

7. The image forming apparatus according to claim 2, further comprising:

a second displacement unit coupled to a recording medium carriage belt driving roller, wherein the second displacement unit displaces the recording medium carriage belt driving roller with a movement of the first displacement unit such that an upstream end of the guide member remains in contact with a front surface of the recording medium carriage belt during the movement of the first displacement unit.

8. The image forming apparatus according to claim 1, wherein the first displacement unit displaces the secondary transfer roller from the contact position to the separate position after the driving of the first image carrier, the first image forming unit, the primary transfer unit, the intermediate transfer belt, and the roller members stretching the intermediate transfer belt is stopped.

9. The image forming apparatus according to claim 1, wherein the first displacement unit further includes an eccentric pulley coupled to the second shaft, the eccentric pulley coupled to one of the pair of elongated links via a protrusion portion.

10. The image forming apparatus according to claim 1, wherein the first displacement unit further includes a worm gear engaging the eccentric gear.

11. The image forming apparatus according to claim 1, wherein the second image carrier is provided on the downstream side of the secondary transfer position in the recording medium conveying direction.

12. An image forming apparatus comprising:

an intermediate transfer belt rotatably stretched across a first plurality of roller members;

a first image carrier arranged facing a front surface of the intermediate transfer belt;

a first image forming unit that forms an image on the first image carrier;

a primary transfer unit that primarily transfers the image formed on the first image carrier onto the intermediate transfer belt;

a secondary transfer roller that is arranged facing the front surface of the intermediate transfer belt and secondarily transfers the image transferred on the intermediate transfer belt onto a recording medium;

a second image carrier provided on an upstream side or a downstream side of a secondary transfer position in a recording medium conveying direction, the secondary transfer position being a position where an image is secondarily transferred from the intermediate transfer belt onto the recording medium;

a second image forming unit that forms an image on the second image carrier;

a direct transfer unit that directly transfers an image formed on the second image carrier onto the recording medium;

a recording medium carriage belt that is rotatably stretched across a second plurality of roller members including the secondary transfer roller and supports and conveys the recording medium so as to pass the recording medium through a direct transfer position and the secondary transfer position, the direct transfer position being a position where the image is directly transferred from the second image carrier onto the recording medium; and a first displacement unit that displaces the secondary transfer roller in a movable manner between a contact position and a separate position, the contact position being a position where the recording medium carriage belt is brought into contact with the intermediate transfer belt and the separate position being a position where the recording medium carriage belt is separated from the intermediate transfer belt retracting from the contact position;

a fixing unit disposed downstream of the secondary transfer position in the recording medium conveying direction; and a pair of stationary guide plates between the secondary transfer position and the fixing unit, wherein the first displacement unit includes a first shaft disposed through a longitudinal axis of the secondary transfer roller, opposite ends of the first shaft extending beyond an longitudinal length of the secondary transfer roller;

a pair of elongated links, each of the elongated links supporting one of the opposite ends of the first shaft;

a second shaft arranged substantially parallel to the first shaft;

a pair of shaft guides separate from the elongated links, the pair of shaft guides including slotted holes elongated in a first direction, the first direction extending perpendicular to an axis of the first shaft toward the second shaft, each of the slotted holes supporting one of the opposite ends of the first shaft; and an eccentric gear coupled to the second shaft, the eccentric gear coupled to one of the pair of elongated links via a protrusion portion, rotation of the eccentric gear displaces the first shaft in the first direction, and the pair of stationary guide plates face one another across a distance transversely spanning a recording medium conveying path.

13. The image forming apparatus of claim 12, further comprising:

a delivery member at an upstream end of one of the pair of stationary guide plates.

14. The image forming apparatus of claim 13, wherein a leading edge of the delivery member contacts an outer surface of the recording medium carriage belt.

15. The image forming apparatus of claim 14, further comprising:

a second displacement unit coupled to the delivery member, wherein the second displacement unit actuates the delivery member to pivot with a movement of the first displacement unit to maintain a contact between the leading edge of the delivery member and the outer surface of the recording medium carriage belt.

16. An image forming apparatus comprising:

an intermediate transfer belt rotatably stretched across a first plurality of roller members;

a first image carrier arranged facing a front surface of the intermediate transfer belt;

a first image forming unit that forms an image on the first image carrier;

a primary transfer unit that primarily transfers the image formed on the first image carrier onto the intermediate transfer belt;

a secondary transfer roller that is arranged facing the front surface of the intermediate transfer belt and secondarily transfers the image transferred on the intermediate transfer belt onto a recording medium;

a second image carrier provided on an upstream side or a downstream side of a secondary transfer position in a recording medium conveying direction, the secondary transfer position being a position where an image is secondarily transferred from the intermediate transfer belt onto the recording medium;

a second image forming unit that forms an image on the second image carrier;

a direct transfer unit that directly transfers an image formed on the second image carrier onto the recording medium;

a recording medium carriage belt that is rotatably stretched across a second plurality of roller members including the secondary transfer roller and supports and conveys the recording medium so as to pass the recording medium through a direct transfer position and the secondary transfer position, the direct transfer position being a position where the image is directly transferred from the second image carrier onto the recording medium; and a displacement unit that displaces the secondary transfer roller in a movable manner between a contact position and a separate position, the contact position being a position where the recording medium carriage belt is brought into contact with the intermediate transfer belt and the separate position being a position where the recording medium carriage belt is separated from the intermediate transfer belt retracting from the contact position, wherein the displacement unit includes a first shaft disposed through a longitudinal axis of the secondary transfer roller, opposite ends of the first shaft extending beyond an longitudinal length of the secondary transfer roller;

a pair of elongated links, each of the elongated links supporting one of the opposite ends of the first shaft;

a second shaft arranged substantially parallel to the first shaft;

a pair of shaft guides separate from the elongated links, the pair of shaft guides including slotted holes elongated in a first direction, the first direction extending perpendicular to an axis of the first shaft toward the second shaft, each of the slotted holes supporting one of the opposite ends of the first shaft; and an eccentric gear coupled to the second shaft, the eccentric gear coupled to one of the pair of elongated links via a protrusion portion, rotation of the eccentric gear displaces the first shaft in the first direction, and a distance between the secondary transfer position and the direct transfer position is an integer multiple of a circumference of one of the second plurality of roller members in contact with an inner surface of the recording medium carriage belt.

17. The image forming apparatus of claim 16, wherein the distance between the secondary transfer position and the direct transfer position is an integer multiple of a circumference of the secondary transfer roller.

18. The image forming apparatus of claim 16, wherein the distance between the secondary transfer position and the direct transfer position is an integer multiple of a circumference of a recording medium carriage belt driving roller.

* * * * *